US005938064A

United States Patent [19]

Smith, Jr.

[11] Patent Number: 5,938,064

[45] Date of Patent: Aug. 17, 1999

[54] STORAGE BOX FOR SCAFFOLDS

[76] Inventor: Ronald G. Smith, Jr., 306 N. 7th St., Wrightsville, Pa. 17368

[21] Appl. No.: 09/048,678

[22] Filed: Mar. 26, 1998

[51] Int. Cl.[6] ..... B65D 25/22

[52] U.S. Cl. ..... 220/475; 220/533

[58] Field of Search ..... 224/543, 620; 182/121; 220/533, 532, 475, 476, 480

[56] References Cited

U.S. PATENT DOCUMENTS

| | | | |
|---|---|---|---|
| 2,854,724 | 10/1958 | Wuorio | 220/533 |
| 4,323,180 | 4/1982 | Sloop | 224/620 |
| 4,960,224 | 10/1990 | Boenisch | 220/532 |
| 5,078,297 | 1/1992 | Howard et al. | 220/532 |
| 5,249,099 | 9/1993 | Sridharan et al. | 220/476 |

FOREIGN PATENT DOCUMENTS

| | | | |
|---|---|---|---|
| 39525 | 11/1931 | France | 220/476 |

*Primary Examiner*—Stephen Castellano

[57] ABSTRACT

A new storage box for scaffolds for securing between vertical supports of a scaffold. The inventive device includes a box portion having a rectangular configuration. The box portion has an open upper end, a closed lower end, a pair of long opposed side walls, and a pair of short opposed end walls. The box portion includes a lid hingedly secured to an upper rear edge thereof for selectively covering the open upper end. Two sets of prongs are secured to exterior surfaces of the pair of short opposed end walls of the box portion. The prongs are vertically oriented with a channel formed therebetween. The channels are dimensioned for engaging vertical support poles of a scaffold.

7 Claims, 2 Drawing Sheets

STORAGE BOX FOR SCAFFOLDS

BACKGROUND OF THE INVENTION

1. Field of the Invention

The present invention relates to storage containers and more particularly pertains to a new storage box for scaffolds for securing between vertical supports of a scaffold.

2. Description of the Prior Art

The use of storage containers is known in the prior art. More specifically, storage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art storage containers include U.S. Pat. No. 4,249,684 to Miller et al.; U.S. Pat. No. 5,160,026 to Marsh; U.S. Pat. No. 5,052,737 to Farmer, Jr.; U.S. Pat. No. 4,653,713 to Hamilton; U.S. Pat. No. 5,121,959 to King; and U.S. Pat. No. Des. 353,049 to Schmidt.

While these devices fulfill their respective, particular objectives and requirements, the aforementioned patents do not disclose a new storage box for scaffolds. The inventive device includes a box portion having a rectangular configuration. The box portion has an open upper end, a closed lower end, a pair of long opposed side walls, and a pair of short opposed end walls. The box portion includes a lid hingedly secured to an upper rear edge thereof for selectively covering the open upper end. Two sets of prongs are secured to exterior surfaces of the pair of short opposed end walls of the box portion. The prongs are vertically oriented with a channel formed therebetween. The channels are dimensioned for engaging vertical support poles of a scaffold.

In these respects, the storage box for scaffolds according to the present invention substantially departs from the conventional concepts and designs of the prior art, and in so doing provides an apparatus primarily developed for the purpose of securing between vertical supports of a scaffold.

SUMMARY OF THE INVENTION

In view of the foregoing disadvantages inherent in the known types of storage containers now present in the prior art, the present invention provides a new storage box for scaffolds construction wherein the same can be utilized for securing between vertical supports of a scaffold.

The general purpose of the present invention, which will be described subsequently in greater detail, is to provide a new storage box for scaffolds apparatus and method which has many of the advantages of the storage containers mentioned heretofore and many novel features that result in a new storage box for scaffolds which is not anticipated, rendered obvious, suggested, or even implied by any of the prior art storage containers, either alone or in any combination thereof.

To attain this, the present invention generally comprises a box portion having a rectangular configuration. The box portion has an open upper end, a closed lower end, a pair of long opposed side walls, and a pair of short opposed end walls. The box portion includes a lid hingedly secured to an upper rear edge thereof for selectively covering the open upper end. A pair of divider walls are slidably disposed between the pair of long opposed side walls of the box portion within longitudinal grooves formed therein. A carrying strap is secured to the box portion. The carrying strap has opposed ends with corresponding hook and loop strips disposed thereon. The opposed ends engage inverted U-shaped brackets secured to the pair of short opposed end walls of the box portion. Two sets of prongs are secured to exterior surfaces of the pair of short opposed end walls of the box portion. The prongs are vertically oriented with a channel formed therebetween. The channels are dimensioned for engaging vertical support poles of a scaffold.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storage box for scaffolds apparatus and method which has many of the advantages of the storage containers mentioned heretofore and many novel features that result in a new storage box for scaffolds which is not anticipated, rendered obvious, suggested, or even implied by any of the prior art storage containers, either alone or in any combination thereof.

It is another object of the present invention to provide a new storage box for scaffolds which may be easily and efficiently manufactured and marketed.

It is a further object of the present invention to provide a new storage box for scaffolds which is of a durable and reliable construction.

An even further object of the present invention is to provide a new storage box for scaffolds which is susceptible of a low cost of manufacture with regard to both materials and labor, and which accordingly is then susceptible of low prices of sale to the consuming public, thereby making such storage box for scaffolds economically available to the buying public.

Still yet another object of the present invention is to provide a new storage box for scaffolds which provides in the apparatuses and methods of the prior art some of the advantages thereof, while simultaneously overcoming some of the disadvantages normally associated therewith.

Still another object of the present invention is to provide a new storage box for scaffolds for securing between vertical supports of a scaffold.

Yet another object of the present invention is to provide a new storage box for scaffolds which includes a box portion having a rectangular configuration. The box portion has an open upper end, a closed lower end, a pair of long opposed side walls, and a pair of short opposed end walls. The box portion includes a lid hingedly secured to an upper rear edge thereof for selectively covering the open upper end. Two sets of prongs are secured to exterior surfaces of the pair of short opposed end walls of the box portion. The prongs are vertically oriented with a channel formed therebetween. The channels are dimensioned for engaging vertical support poles of a scaffold.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
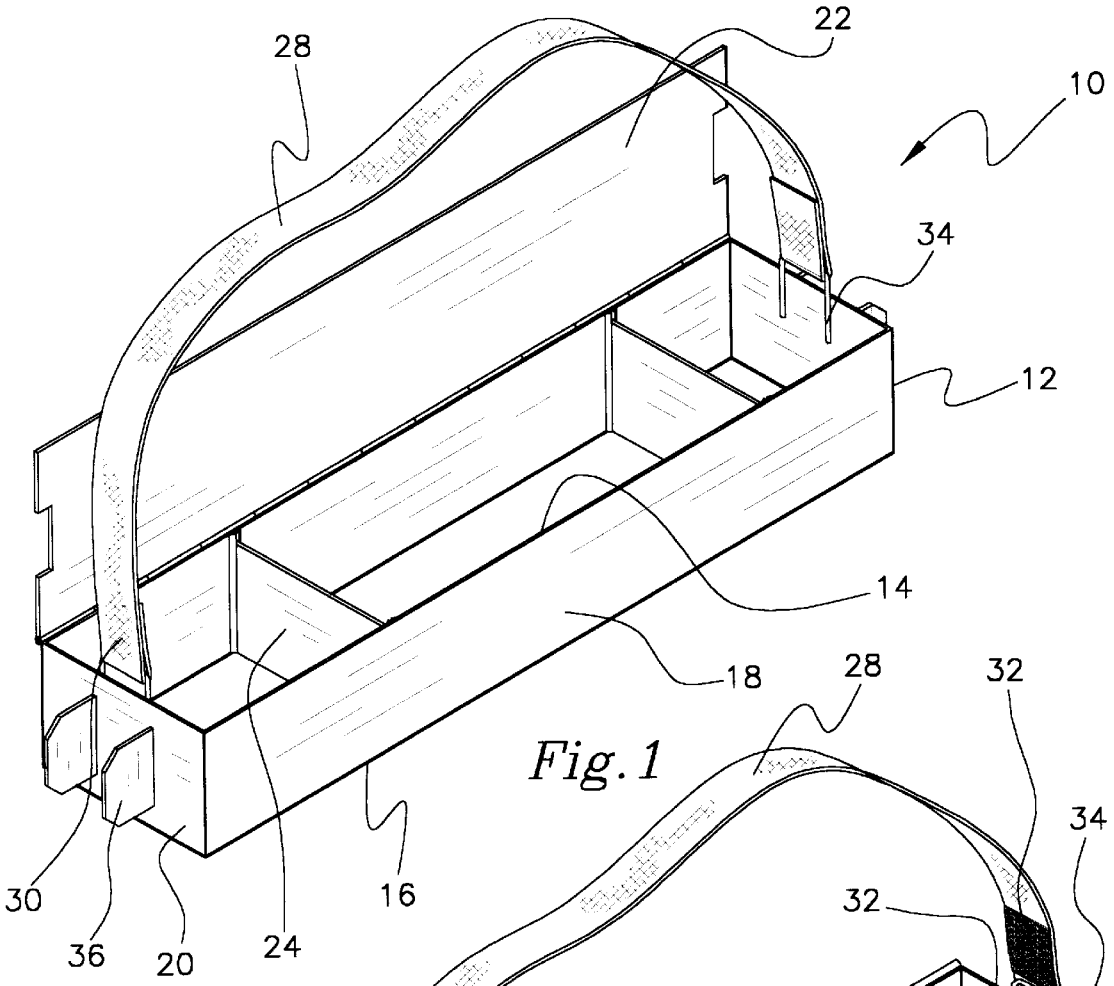
FIG. 1 is a perspective view of a new storage box for scaffolds according to the present invention.
Figure 2:
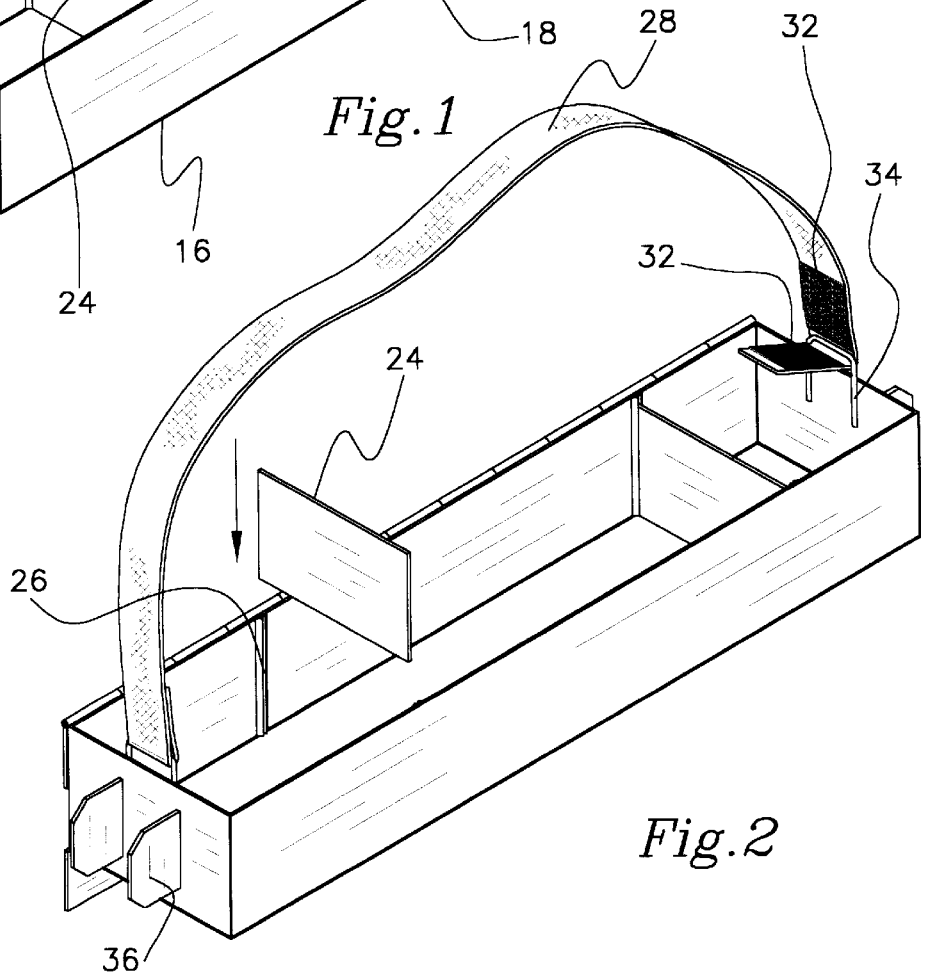
FIG. 2 is a perspective view of the present invention illustrating the removable dividers thereof.

With reference now to the drawings, and in particular to FIGS. 1 through 4 thereof, a new storage box for scaffolds embodying the principles and concepts of the present invention and generally designated by the reference numeral 10 will be described.

As best illustrated in FIGS. 1 through 4, the storage box for scaffolds 10 comprises a box portion 12 having a rectangular configuration. The box portion 12 has an open upper end 14, a closed lower end 16, a pair of long opposed side walls 18, and a pair of short opposed end walls 20. The box portion 12 includes a lid 22 hingedly secured to an upper rear edge thereof for selectively covering the open upper end 14.

A pair of divider walls 24 are slidably disposed between the pair of long opposed side walls 18 of the box portion 12 within longitudinal grooves 26 formed therein. The divider walls 24 are included in order to facilitate organization of tools and the like.

A carrying strap 28 is secured to the box portion 12. The carrying strap 28 has opposed ends 30 with corresponding hook and loop strips 32 disposed thereon. The opposed ends 30 engage inverted U-shaped brackets 34 secured to the pair of short opposed end walls 20 of the box portion 12.

Two sets of prongs 36 are secured to exterior surfaces of the pair of short opposed end walls 20 of the box portion 12. The prongs 36 are vertically oriented with a channel formed therebetween. The channels are dimensioned for engaging vertical support poles 38 of a scaffold.

Figure 3:
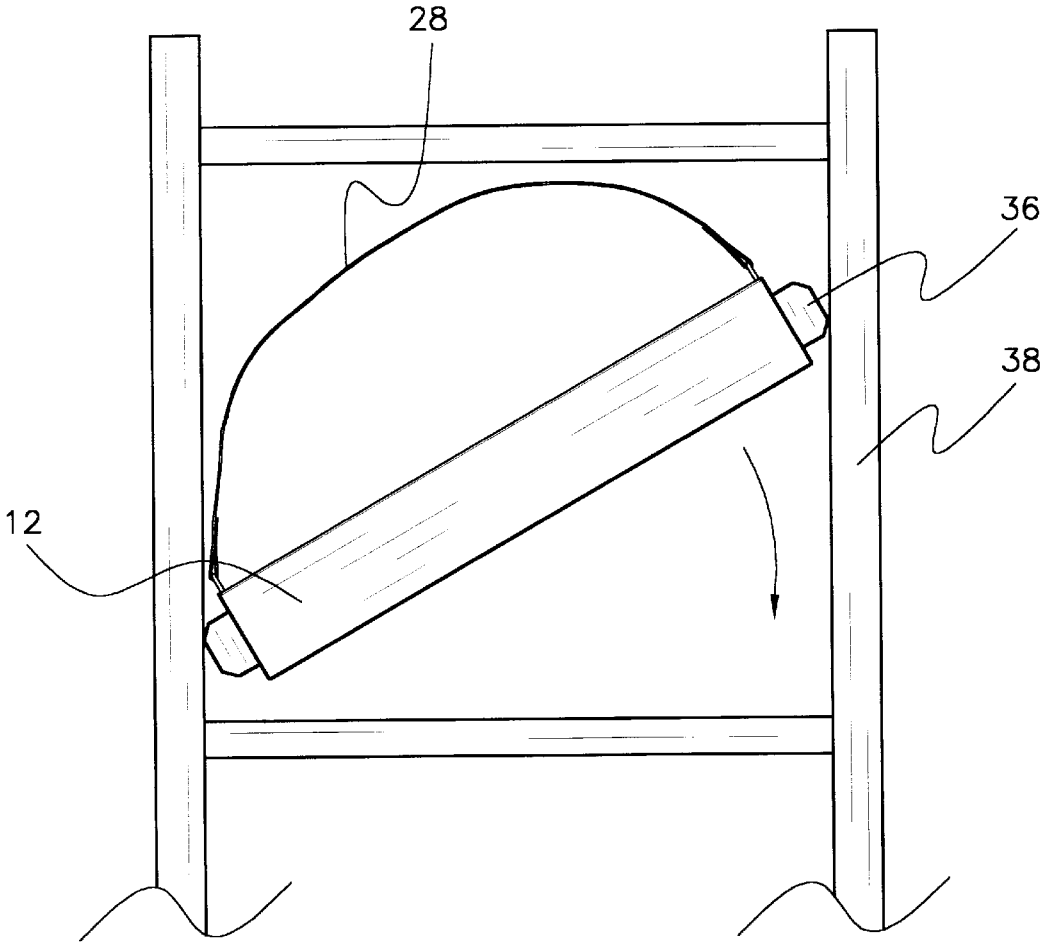
FIG. 3 is a side view of the present invention illustrated in use.
Figure 4:
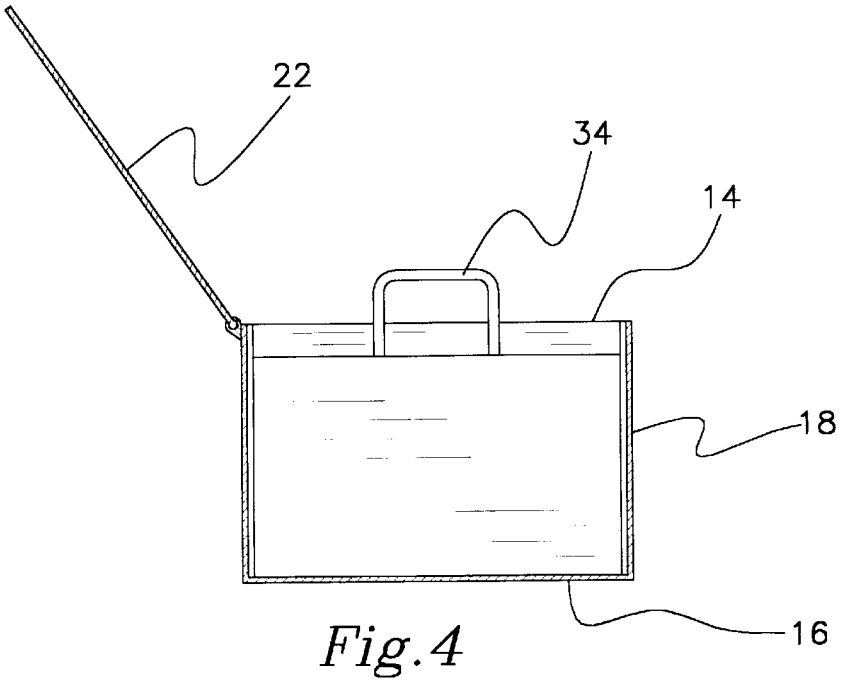
FIG. 4 is a cross-sectional end view of the present invention.

In use, the present invention would first be installed onto the scaffold in an upward diagonal direction, note FIG. 3, but would be secured into position when pushed down. Once positioned, the hinged lid 22 over the open upper end 14 could be flipped open, providing access to an interior of the box portion 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage box for scaffolds for securing between vertical supports of a scaffold comprising, in combination:

a box portion having a rectangular configuration, the box portion having an open upper end, a closed lower end, a pair of long opposed side walls, and a pair of short opposed end walls, the box portion including a lid hingedly secured to an upper rear edge thereof for selectively covering the open upper end;

a pair of divider walls slidably disposed between the pair of long opposed side walls of the box portion within longitudinal grooves formed therein;

a carrying strap secured to the box portion, the carrying strap having opposed ends with corresponding hook and loop strips disposed thereon, the opposed ends engaging inverted U-shaped brackets secured to the pair of short opposed end walls of the box portion; and two sets of prongs secured to exterior surfaces of the pair of short opposed end walls of the box portion, the prongs being vertically oriented with a channel formed therebetween, the channels being dimensioned for engaging vertical support poles of a scaffold.

2. A storage box for securing between vertical supports of a scaffold comprising:

a box portion having an elongate configuration, the box portion having a pair of relatively longer side walls and a pair of relatively shorter end walls;

two sets of prongs secured to exterior surfaces of the pair of short opposed end walls of the box portion, each set of prongs extending in an opposite longitudinal direction from the other set of prongs, each set of prongs forming a channel dimensioned for engaging vertical support poles of a scaffold; and a carrying strap having opposed ends connected to longitudinally spaced locations on the box portion for suspending the box portion from a user's shoulder such that a scaffold engaged by the channels may be carried by the shoulder of a user wherein the opposed ends of the carrying strap have corresponding hook and loop strips disposed thereon, the opposed ends engaging inverted U-shaped brackets secured to the pair of short opposed end walls of the box portion.

3. The storage box for scaffolds as set forth in claim 2 and further including a pair of divider walls slidably disposed between the pair of long opposed side walls of the box portion within longitudinal grooves formed therein.

4. The storage box for scaffolds as set forth in claim 2 wherein the box portion has an open upper end and a closed lower end.

5. The storage box for scaffolds as set forth in claim 4 wherein the box portion includes a lid hingedly secured adjacent to the open upper end thereof for selectively covering the open upper end.

6. A storage box for scaffolds for securing between vertical supports of a scaffold comprising:

a box portion having a rectangular configuration, the box portion having an open upper end, a closed lower end, a pair of long opposed side walls, and a pair of short opposed end walls, the box portion including a lid hingedly secured to an upper rear edge thereof for selectively covering the open upper end;

two sets of prongs secured to exterior surfaces of the pair of short opposed end walls of the box portion, the prongs being vertically oriented with a channel formed therebetween, the channels being dimensioned for engaging vertical support poles of a scaffold;

a carrying strap secured to the box portion; and wherein the carrying strap has opposed ends with corresponding hook and loop strips disposed thereon, the opposed ends engaging inverted U-shaped brackets secured to the pair of short opposed end walls of the box portion.

7. The storage box for scaffolds as set forth in claim 6 and further including a pair of divider walls slidably disposed between the pair of long opposed side walls of the box portion within longitudinal grooves formed therein.

* * * * *